US005228507A

United States Patent [19]

Obrejanu et al.

[11] Patent Number: 5,228,507

[45] Date of Patent: Jul. 20, 1993

[54] WIRELINE HYDRAULIC RETRIEVING TOOL

[76] Inventors: Marcel Obrejanu, 248 Riverbend Dr., SE., Calgary, Alberta, Canada, T2C 3X8; David H. Weiler, 51 Tararidge Close, NE., Calgary, Alberta, Canada, T3J 2P5

[21] Appl. No.: 749,176

[22] Filed: Aug. 23, 1991

[51] Int. Cl.[5] ..... E21B 31/00

[52] U.S. Cl. ..... 166/98; 166/66.4; 166/301; 294/86.18

[58] Field of Search ..... 166/98, 301, 385, 65.1, 166/178, 66.4; 294/86.18, 86.23

[56] References Cited

U.S. PATENT DOCUMENTS

| | | | |
|---|---|---|---|
| 2,337,249 | 1/1945 | Lawrence | 294/86 |
| 2,537,413 | 11/1946 | Lawrence | 294/86.1 |
| 2,829,716 | 4/1958 | Stewart | 166/98 |
| 2,978,030 | 4/1961 | Green et al. | 166/98 |
| 3,016,954 | 1/1962 | Crowell | 166/98 |
| 3,105,547 | 10/1963 | Ownby | 166/66.4 |
| 3,105,550 | 10/1963 | Ehlert | 166/66.4 |
| 3,134,441 | 5/1964 | Barry et al. | 166/66.4 |
| 3,147,809 | 9/1964 | Thomas | 166/98 |
| 3,211,222 | 10/1965 | Myers | 166/98 X |
| 4,762,175 | 8/1988 | Perricone | 166/178 X |

FOREIGN PATENT DOCUMENTS

| | | |
|---|---|---|
| 1157460 | 11/1983 | Canada . |
| 1177058 | 10/1984 | Canada . |
| 1197835 | 12/1985 | Canada . |
| 1221960 | 5/1987 | Canada . |
| 1259603 | 9/1989 | Canada . |

*Primary Examiner*—Hoang C. Dang
*Attorney, Agent, or Firm*—Hoffman, Wasson & Gitler

[57] ABSTRACT

In wireline operations, it is known to retrieve objects stuck in a well bore by application of a retrieving force applied to the object through the wireline and a wireline pulling tool attached to the wireline and engaged with the object. The present invention provides a wireline retrieving tool which is adapted to apply a large retrieving force on a pulling tool engaged with an object in the well bore without having that force transmitted directly through the wireline. The retrieving tool is adapted to be lowered into the well bore on the wireline to a position where the pulling tool engages the stuck object. Slips carried on in the tool then anchor the tool against the tubular casing or tubing of the well bore and a controlled retrieving force generated in the tool by an electric motor and hydraulic pump is applied between the casing or tubing and the pulling tool to dislodge the object.

4 Claims, 4 Drawing Sheets

WIRELINE HYDRAULIC RETRIEVING TOOL

This invention relates to wireline retrieving tools for use in retrieving objects from a well bore.

BACKGROUND OF THE INVENTION

During the production of hydrocarbons from underground rock formations, a tubing string extending from surface to the required depth in a well bore may be used to complete a well. To allow for different production operations or the downhole control of fluid flow, wireline tools such as plugs, chokes, safety valves, check valves, etc. may be placed in landing nipples in the tubing string. It is fairly common for such wireline tools to become stuck in the landing nipple. The general method used in attempting to retrieve such tools, or other objects stuck in a well bore, generally referred to as "fish", is through the use of a wireline pulling tool which is adapted to be attached to the wireline, and to engage the fish. In that method retrieval force is applied directly through the wireline. However, the strength of the wireline limits the amount of force available to dislodge the fish. If excessive force is applied, the wireline may break. In that case the wireline will fall to the bottom of the well and a very expensive fishing job is necessary to retrieve it.

Another method used to retrieve fish is the use of a "sucker rod" string which is run down the well via a service rig. Use of a sucker rod allows more force to be transmitted downhole. However, this method requires a very expensive operation.

One prior tool which is adapted to be utilized in conjunction with an operating string of tubing, is disclosed in U.S. Pat. No. 2,377,249 (Lawrence). That tool utilizes a series of cylinders with anchoring means for anchoring the cylinders to the well casing and with pistons in the cylinders connected to a grapple adapted to engage stuck pipe or other objects in a well. The pistons are designed to be actuated by liquid under pressure in the cylinders to exert a pull on the grapple and on the stuck object to dislodge the latter. The driving force for exerting the pull and anchoring the cylinder to the well casing is provided through operating fluid forced under pressure through the operating string from surface. While the tool is adapted to exert a force on the stuck object without exerting a force on the operating string, it is not adapted for use with wireline and involves the expense and difficulties encountered in running an operating string down a producing well.

A different system has been developed by Petro-Tech Tools Inc. in the United States. In that system, an explosive charge is detonated downhole in order to generate a dislodging force without all of the force being transmitted through the wireline. However, the explosive force cannot be adequately controlled, and damage may be caused to the tubing string, or the pulling tool.

SUMMARY OF THE INVENTION

Therefore, it is an aim of the present invention to overcome problems heretofore encountered with the retrieval of tools or other objects stuck in a well bore.

Accordingly, the present invention provides a wireline retrieving tool for use in the retrieval of objects such as tools from the interior of a tubing string in a well bore, the retrieving tool comprising an assembly adapted to be lowered on a wireline through the interior of the tubing string to the location of the object to be retrieved, the assembly including connecting means for engaging a wireline pulling tool adapted to engage the object, anchoring means selectively operable to anchor the assembly securely against the interior wall of the tubing string, the assembly being adapted for relative axial movement between the anchoring means and the connector means, and force generating means adapted to apply a controlled force between the anchoring means and the connector means to urge the connector means, pulling tool, and object in the retrieval direction.

Preferably, the force generating means include an electric motor carried in the assembly. The motor may be powered by electricity supplied from surface through the wireline, or by electricity supplied from a downhole power pack carried in the assembly. In a preferred embodiment, the force generating means comprises a fluid motor powered by fluid pressure generated by the electric motor and a hydraulic pump carried in the assembly. However, it is contemplated that mechanical connections and driving means between the electric motor, anchor and connecting means could be employed.

When the power source comprises an electric motor supplied with electricity through the wireline, an electric wireline will be used. However, when a downhole power pack is utilized, ordinary wireline, coiled tubing, electric wireline, or any mechanical means suitable for conveying the retrieving tool in a well may be used.

Generally, one of the main advantages of the invention is that it provides a wireline tool capable of exerting considerable retrieving force between the tubing string and the fish to be dislodged without exerting any load on the wireline itself. This is accomplished in such a manner that the force can be controlled so as to prevent damage to the tubing string, retrieving tool, pulling tool, or the object which is stuck in the well.

BRIEF DESCRIPTION OF THE DRAWINGS

The invention and its advantages will be more fully described by way of example in the following description of two preferred embodiments with reference being made to the accompanying drawings in which.

DESCRIPTION OF THE PREFERRED EMBODIMENTS

Figure 1A:
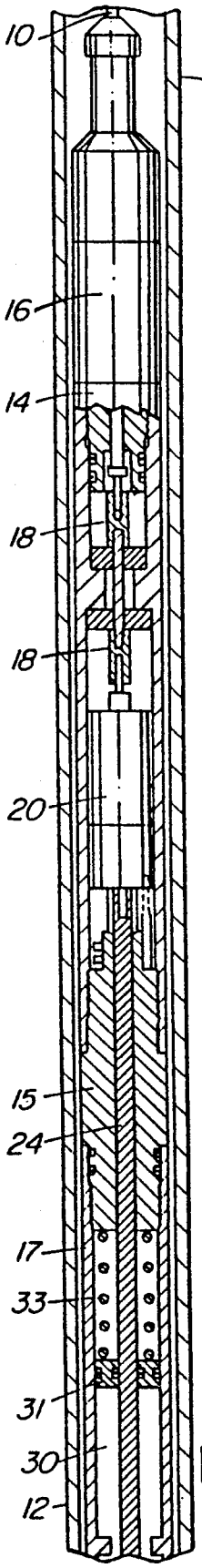
FIGS. 1*a*, 1*b*, and 1*c* are successive portions of a sectional view of the retrieving tool with a wireline pulling tool attached.

Referring to FIG. 1, the wireline retrieving tool comprises an assembly adapted to be lowered on a wireline 10 through the interior of the tubing string 12. The retrieving tool is attached to the wireline 10 by upper connecting means of, namely cross head assembly 16. The cross head assembly 16 is connected to a motor housing 14 at the top of the retrieving tool. The wireline 10 is an electric wireline with electricity being conducted from the wireline 10 through the cross head 16 and an electrical subsystem designated generally 18 to an electric motor 20 in motor housing 14. The motor housing 14 which encloses the electrical subsystem 18 and the motor 20 is connected to a tubular connecting subassembly 15 which is in turn connected to a tubular hydraulic pump housing 17. The electric motor 20 is coupled to a hydraulic pump 22 in the pump housing 17 by means of a drive shaft 24. The electric motor 20 and hydraulic pump 22 are adapted to generate fluid pressure for driving a fluid motor which comprises the force generating means of the retrieving tool. The motor housing 14, connecting subassembly 15, and pump housing 17 form a power subassembly of the retrieving tool.

The fluid motor comprises a hydraulic piston and cylinder arrangement defined within the pump housing 17 and between an axially extending mandrel 26 which is attached to the pump housing 17, and a tubular housing 28 surrounding the mandrel 26 and axially slidable thereon.

Figure 1B:
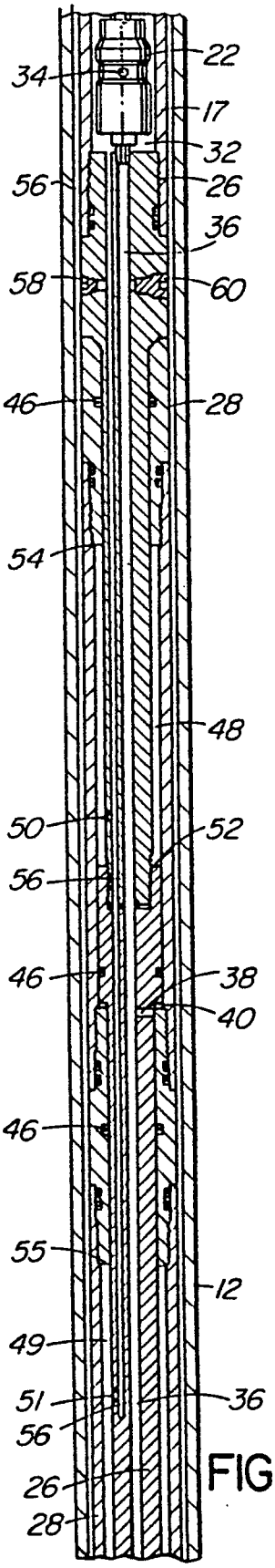

As seen at the top of FIG. 1*b*, the pump 22 is positioned within the pump housing 17 in a pump compartment 32 that communicates with a reservoir compartment 30 (FIG. 1*a*), the pump having suction ports 34 opening to the compartment 32. At the upper end of the compartment 30, an annular piston 31 slides in sealing engagement with the shaft 24 and the housing 17. The piston 31 is pressed downwardly by a coiled compression spring 33. The pump is connected to deliver hydraulic fluid to a pressure passage 36 extending axially within the mandrel 26 and having axially spaced ports 38, 39 leading to axially spaced upper and lower variable volume pressure cylinder chambers 40, 41 respectively, which are defined between the axially movable tubular housing 28 and the mandrel 26. The pressure cylinder chambers 40, 41 have minimum volume in the condition shown in FIGS. 1*b* and 1*c*, and are perhaps more clearly shown in FIGS. 2*b* and 2*c*. As seen in FIG. 2*b*, the upper chamber 40 is defined between an annular shoulder 42 on the mandrel and an opposed annular shoulder 44 on the tubular housing 28, and is sealed at opposite ends by means of O-ring seals 46 positioned between the cylindrical surfaces of the mandrel 26 and tubular housing 28. Similarly, the lower pressure chamber 41 is defined between an annular shoulder 43 on the mandrel and an opposed annular shoulder 45 on the tubular housing 28, the lower pressure chamber 41 likewise being sealed by O-ring seals 46 arranged between the cylindrical surfaces of the mandrel and tubular housing.

Upper and lower variable volume reservoir chambers 48, 49 (FIG. 1*b*) are defined between opposed annular shoulders 52, 53 on the mandrel 26 and 54, 55 on the tubular housing 28, respectively. These reservoir cylinder chambers 48, 49 are connected via respective ports 50, 51 to an axially extending suction passage 56 in the mandrel 26, the passage 56 opening into the compartment 32. The reservoir cylinder chambers are likewise sealed by O-ring seals 46 positioned between the sliding surfaces of the mandrel 26 and tubular housing 28.

Hydraulic fluid for use in the fluid motor is placed into the system through filling port 58 which is connected to suction passage 56. The fluid may be removed through venting port 60 which is connected to pressure passage 36.

The pressure cylinder chambers 40, 41, reservoir cylinder chambers 48, 49, and tubular housing 28 are interrelated such that, when the pressure chambers 40, 41 expand, the reservoir chambers 48, 49 contract, and the tubular housing 28 moves downward relative to the mandrel 26 toward the bottom of the tool.

The reservoir compartment 30 provides a very specific function in the operation of the system to account for variations in the volume of the hydraulic fluid, and also to ensure that the hydraulic system is in all cases pressurized. Provision must be made for expansion of the volume of the hydraulic system since under the elevated temperature conditions encountered downhole, the hydraulic fluid will expand and could otherwise generate high internal pressure which might damage the tool. Such expansion is provided for by the piston 31 which can move upwardly against the force of the spring 33 to accommodate the expansion, and can also move downwardly when the hydraulic fluid is compressed under the pumping pressure, and its volume is reduced. Because of the tortuous configuration of the hydraulic system and the various small passages thereof, it is probable that small amounts of air will be trapped within the hydraulic chambers. Under pumping pressure, such air will of course compress much more than the hydraulic fluid so that there may be a significant reduction in volume. Such reduction is easily accommodated by movement of the piston 31, and the force of the spring 33 will ensure that the reservoir compartment 30 is at all times under a positive pressure, so that there is a positive head at the suction port 34 of the pump.

The bottom of the tubular housing 28 is connected to a setting cone 62 which terminates in tapered ends toward the bottom of the tool.

Anchoring means for anchoring the assembly to the interior wall of the tubing string 12 in the well bore consist of a plurality of circumferentially divided slips 64 encircling the mandrel 26 and carried on a slip housing 66 surrounding the mandrel 26. The slips 64 have an internally tapered surface 63 (FIG. 1*c*) extending toward the setting cone 62 and adapted for engagement by the tapered ends of the setting cone 62. The outer surface 65 of the slips 64 is serrated to provide gripping engagement of the slips 64 with the interior wall of the tubular string 12. The slips 64 are resiliently biased toward the mandrel 26 by means of springs 67.

The slip housing 66 is a radially expandable collet housing surrounding the mandrel 26. Detent means 68 between the collet type slip housing 66 and the mandrel 26 releasably hold the slip housing 66 at a set position on the mandrel 26. The detent means 68 are adapted to prevent axial movement between the slip housing 66 and the mandrel 26 at least until a sufficient force is applied between the slip housing 66 and the mandrel 26 to expand the slip housing 66 and release the detent means 68. In this way, the slips 64 are held at a position where they may be engaged by the tapered ends of setting cone 62 and thereby be urged radially outward until they are fully actuated and securely anchored on the interior wall of the tubular string 12. While use of a collet type slip housing 66 is a preferred means of holding the slips 64 at a position where they my be actuated, it is contemplated that other means, such as a shear pin arrangement, may be used for releasably holding the slip housing.

The mandrel 26 terminates toward the bottom of the retrieving tool assembly in a threaded end 70 which is connected to a release adapter 72. The release adapter 72 provides connector means for connecting a wireline pulling tool 74 to the retrieving tool assembly. The release adapter 72 is constructed with a narrow middle section 76 which is adapted to fracture when a predetermined force is applied to it. The wireline pulling tool 74 is adapted to engage the fish (not shown) which is to be retrieved from the well bore. The retrieving tool and release adapter 72 are designed for use with known wireline pulling tools 74. Generally, the wireline pulling tool 74 will be adapted to engage an outside pulling flange or internal pulling neck on the fish.

In operation, the wireline pulling tool 74 is first attached to the wireline retrieving tool assembly. The retrieving tool and attached pulling tool 74 are then run down the interior of the tubing string 12 until the pulling tool engages the fish. Known wireline techniques and equipment are used for this purpose. Once the pulling tool 74 engages the fish, light upward tension is applied to the wireline 10. This upward pressure is maintained throughout the pulling operation.

Electricity is transmitted down the wireline 10, from a power source at the surface of the well bore, to the motor 20. The motor 20 activates the hydraulic pump 22 through shaft 24. Hydraulic fluid is then drawn from the pump compartment 32 by the pump and forced under pressure through the pressure passage 36 into the pressure cylinder chambers 40, 41. The pressure cylinder chambers 40, 41 expand, the reservoir chambers 48, 49 contract, and the tubular housing 28 and setting cone 62 are forced downward on the mandrel 26. The slips 64 are initially supported by the detent means 68 of the slip housing 66 and the mandrel 26 and are held retracted from the wall of the string 12 by the springs 67. Thus, as the tubular housing 28 moves downward on the mandrel 26, the tapered end of the setting cone 62, engages the internally tapered surface 63 of the slips 64 and actuates the slips 64 by expanding them radially and forcing the serrated outer surface 65 into gripping engagement with the interior wall of the tubular string 12.

Figure 2B:
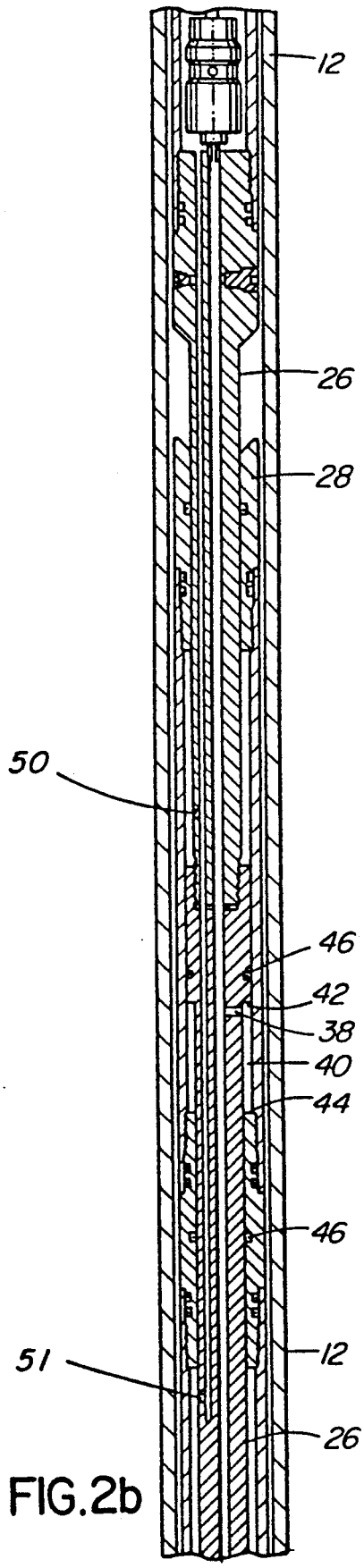
FIGS. 2*b*, and 2*c* are successive portions of a sectional view of the retrieving tool corresponding to FIGS. 1*b*, and *c*, but with the retrieving tool part way through its pulling stroke.
Figure 2C:
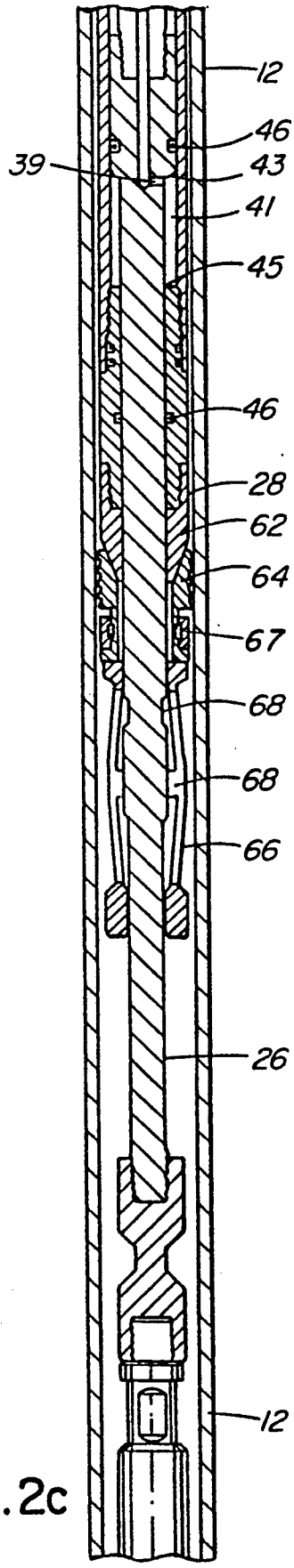

When the slips 64 are securely anchored on the interior wall of the tubing string 12, the tubular housing 28 can no longer move downward in the well bore and the fluid pressure in the pressure chambers 40, 41 exerts upward force on the mandrel 26, thereby applying, through the pulling tool 74, an upward retrieving force on the fish. As best seen in FIG. 2*c*, upon upward movement of the fish, and when there is sufficient force between the slip housing 66, and the mandrel 26, the detent means 68 on the mandrel 26 and the slip housing 66 will release, and the mandrel 26 will move upward relative to the slip housing 66. The slips 64 will continue to be held against the tubing string wall 12 by the setting cone 62 until the mandrel 26 has moved upward through the full length of the pulling stroke of the retrieving tool.

Figure 3B:
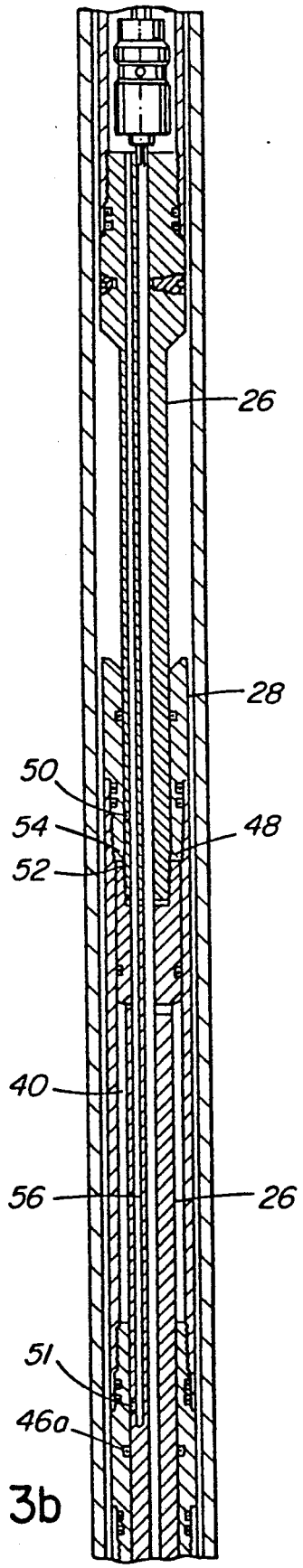
FIGS. 3*b*, and 3*c* are successive portions of a sectional view of the retrieving tool corresponding to FIGS. 1*b*, and *c*, but with the retrieving tool at the end of its pulling stroke.
Figure 3C:
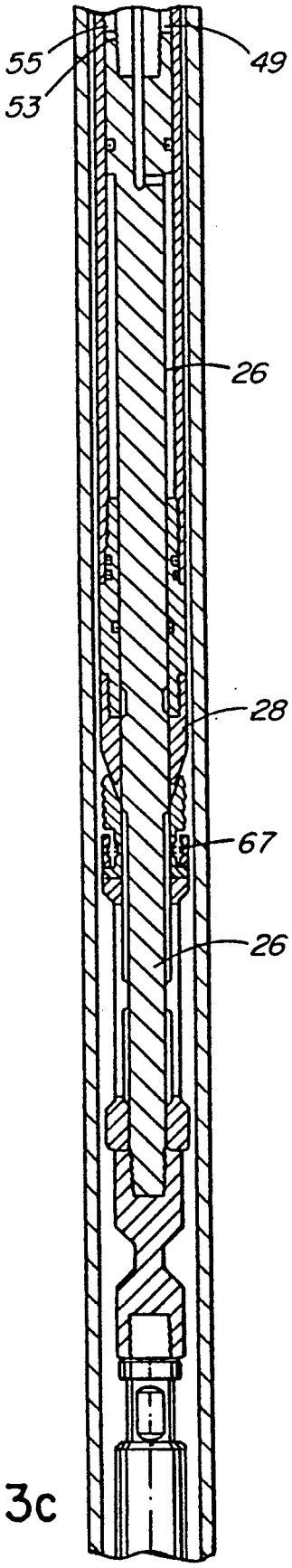

As best seen in FIG. 3, at the end of the pulling stroke, mandrel 26 will be restrained from further upward movement relative to the tubular housing 28 since the reservoir cylinder chambers 48, 49 will have collapsed and the internal annular shoulders of the tubular housing 54, 55 will abut on the annular shoulders 52, 53 of the mandrel 26. The length of the pulling stroke of the retrieving tool assembly is also determined by the position of the lower reservoir communicating port 51. That port will allow communication between the pressure cylinder chamber 40 and the suction passage 56 when the port 51 travels past O-ring 46*a* between the tubular housing 28 and the mandrel 26. Therefore, once the suction port 51 travels past the O-ring 46*a*, the hydraulic pressure in the pressure cylinder chambers 41, 42 will be equalized with the hydraulic pressure in the reservoir cylinder chambers 48 and 49 and the pulling force of the tool will be removed.

At the end of the pulling stroke, the slips 64 will be released from the tubing string 12 when continued upward pressure on the wireline 10 pulls the mandrel 26 and consequently the tubular housing 28 and setting cone 62 upward. The slips 64 will remain engaged with the tubing string until withdrawal of the setting cone 62 allows the slips 64 to retract from the tubing string 12 under the bias of the springs 67.

Once the fish has been dislodged in the well bore and the slips 64 have retracted from the tubing string 12, the tension on the wireline 10 will be diminished. At that point, the operators will know that the fish has been dislodged, and will pull the retrieving tool assembly, pulling tool and fish from the well bore.

Two levels of power will be used to control the retrieving tools operating sequence. The first level is used to attempt to remove the fish. The second level will produce a higher pulling force adapted to fracture the narrow section 76 of the release adapter 72. Thus, if the object cannot be dislodged, the retrieving tool can be retrieved from the well bore by breaking the release adaptor.

Figure 4:
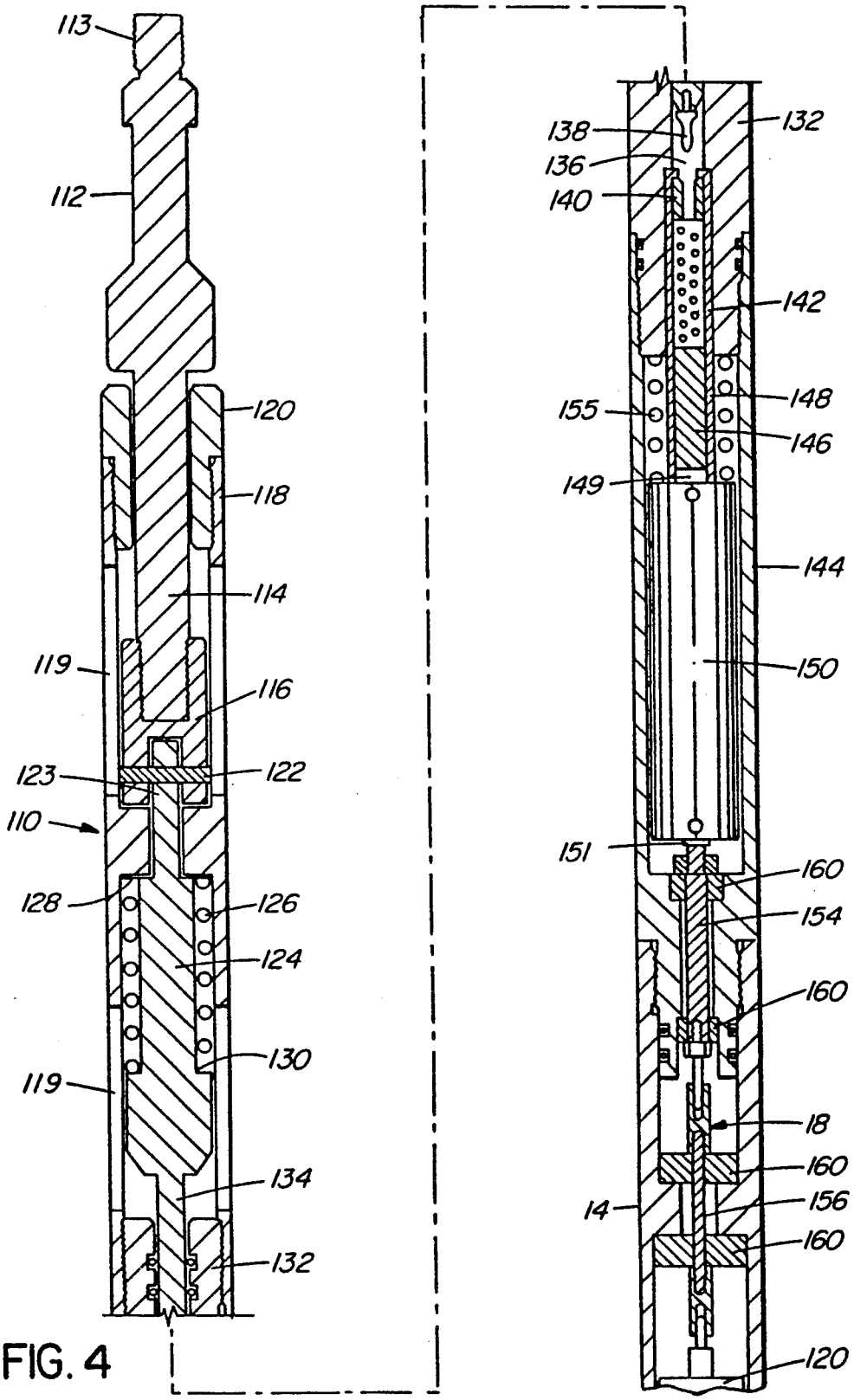
FIG. 4 is a sectional view of the top portion of an embodiment of the retrieving tool having a downhole power pack.

Referring to FIG. 4, in a second preferred embodiment, electric power is supplied to the electric motor by means of a downhole power pack or power generator assembly which is attached to the retrieving tool to form a subassembly of the retrieving tool assembly. FIG. 4 shows a sectional view of the power generator assembly, designated generally 110, and the top section of the remainder of the retrieving tool assembly including the electrical subsystem 18 and the top of the motor 20. The power generator assembly 110, is attached on the retrieving tool assembly in place of the cable head assembly 16 shown in FIG. 1, by attaching the bottom of power pack housing 144 of the power generator assembly to the top of motor housing 14 of the hydraulic retrieving tool. The motor housing 14, electrical subsystem 18, motor 20 and the remainder of the retrieving tool assembly (not shown) are identical to the elements described above with respect to the first embodiment.

The top of the power generator assembly is connected to a mechanical jar (not shown) which is in turn connected to the wireline. As discussed more fully below, the mechanical jar is adapted to impart an upward jarring stroke to a top subassembly 112 of the power generator assembly in order to close an electrical circuit between the power pack 150 and the motor 20 when the jar is tensioned by means of a pulling force through the wireline after the wireline pulling tool has latched onto the fish.

As shown on FIG. 4, the power generator assembly includes the top subassembly 112 which has a top threaded cylindrical portion 113 adapted to be attached to the mechanical jar. The top subassembly 112 includes an axially extending mandrel 114 the bottom of which is connected to a shearing subassembly 116. The shearing subassembly 116 is surrounded by and adapted to slide in cylindrical housing 118. The shearing subassembly 116 and consequently the bottom of mandrel 114 are retained in the housing 118 by means of a retaining cap 120 which is attached to the top of the shear housing 118. The mandrel 114 is slidable in the bore of the retaining cap 120.

An axially extending contact mandrel 124, having an upper rod 123 and a lower contact rod 134, is held in the shearing subassembly 116 by means of shear pin 122 which passes through aligned transverse bores in rod 123 and in the shearing subassembly 116. The contact mandrel 124 is located in, and adapted to slide in the shear housing 118 and is biased toward the bottom of the power generator assembly 110 by a compression spring 126 which abuts on annular shoulder 128 on the housing 118 and on annular shoulder 130 of contact mandrel 124. Bleeding ports 119 in the sides of the housing 118 ensure that fluid under pressure does not become trapped within the housing 118 during activation of the power generator assembly.

The housing 118 is connected to contact subassembly 132. The contact rod 134 of the contact mandrel 124 is adapted to slide in an axial passage 136 in the contact subassembly 132. A contact pin 138 carried at the lower end of the contact rod 134 is adapted to be engaged in a contact sleeve 140 which is held in an insulating sleeve 142 in the passage 136.

The contact subassembly 132 is attached to a tubular power pack housing 144. The contact sleeve 140 is electrically connected to a second contact rod 146 which is held in an insulating sleeve 148 that is attached to insulating sleeve 142. The contact rod 146 is electrically connected at the lower end to a terminal 149 of the power pack 150. A third contact rod 154 electrically connects a second terminal 151 of the power pack 150 to the electrical subassembly 18 of the hydraulic retrieving tool. The power pack 150 is held and is pressed against the third contact rod 154 by a compression spring 155, this arrangement providing reliable electrical contact and avoiding damaging of the power pack under shock loads. This electrical subassembly corresponds to the electrical subsystem 18 shown on FIG. 1. The subassembly is connected to the electric motor 20 which is designated 20 on FIG. 1. As noted, the remainder of the hydraulic retrieving tool is as described above with respect to the first embodiment.

Electrical insulators 160 are utilized to ensure that there is no contact between the contact rod 154 or the electrical subassembly 156 and the body of the power generator assembly 110 or the hydraulic retrieving tool assembly generally.

In operation, the top of the mechanical jar (not shown) is attached to the wireline (not shown), and the retrieving tool assembly including the power generator assembly 110 is attached to the mechanical jar. The entire assembly with a wireline pulling tool attached is run down the bore hole until the pulling tool engages the fish. When this occurs, an upward tension sufficient to cause an upward jarring stroke of the jar is placed on the wireline. The upward stroke of the jar imparts a jarring impact on top subassembly 112, mandrel 114, and shear subassembly 116. This upward jar is sufficient to shear the shear pin 122. When the pin 122 is sheared, the contact mandrel 124 moves downward under the bias of spring 126 and contact pin 138 enters contact sleeve 140. This closes the electrical circuit of the power generator subassembly which consists of the body of the assembly (ground), the power pack 150, the various contact rods and contact pins of the assembly, and the electric motor 20. Prior to the pin 138 entering contact sleeve 140 the circuit is open, there being no connection between ground and the remainder of the circuit. When the circuit is closed (i.e., when pin 138 enters sleeve 140), the electric motor 20 is activated and the retrieving tool applies an upward retrieving force on the fish in the manner described above. Once the pulling sequence of the tool is initiated, it will continue until completed, and the electric motor 20 will continue to run until the power pack 150 runs out of power.

Figure 1C:
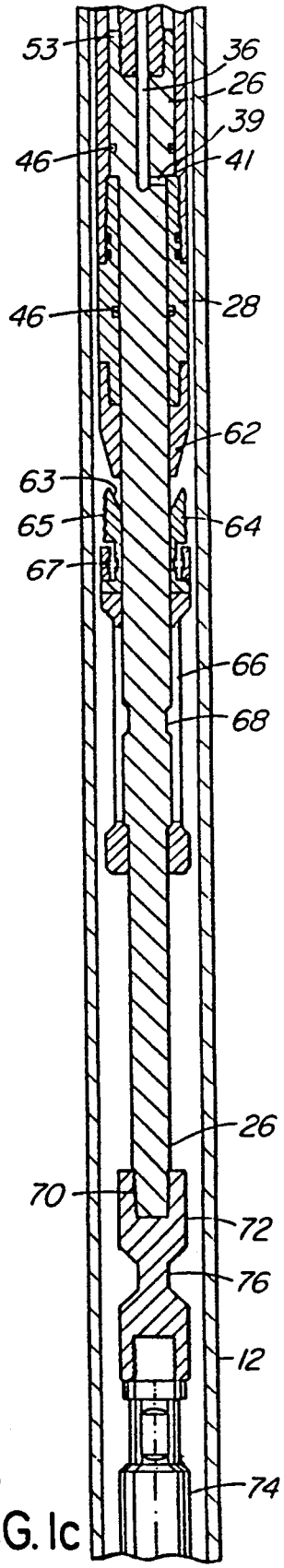

Only one power level is used in this embodiment, and that level is adapted to fracture the narrow section 76 of the release adapted 72 (see FIG. 1*c*). Thus, if the fish is not dislodged, the release adapter will be fractured when the load reaches the shear value of the section 76 and the retrieving tool will be retrievable from the well bore.

As noted above, this embodiment of the retrieving tool assembly may be run on wireline, electric wireline, coil tubing, or any other mechanical means suitable for conveying the retrieving tool in a well to retrieve a fish. This embodiment will be most useful when a power source is not readily available at the surface of the well.

Those skilled in the technical field of the invention will understand that the above detailed description is by way of example only. Modifications may be made to the specific tools described within the spirit of the invention as defined in the appended claims.

What we claim as our invention is:

1. A wireline retrieval tool for retrieving objects stuck in the interior of a tubing string in a well bore comprising an assembly adapted to be connected to and lowered on a wireline through the interior of a tubing string, the assembling comprising:

(a) upper connecting means for connecting the assembly to the wireline;

(b) lower connecting means for engaging a wireline pulling tool adapted to engage the object;

(c) a fluid motor powered by pressurized fluid supplied by a hydraulic pump driven by an electric motor, the pump and motor being carried in a power subassembly attached to the upper connecting means;

(d) an electrical subsystem for supplying electricity to the electric motor from a power source;

(e) an axially extending mandrel attached at one end to the power subassembly and attached at the other end to the lower connector means;

(f) a tubular housing surrounding the mandrel and axially slidable thereon;

(g) anchoring means adapted to selectively anchor the tubular housing to the interior wall of the tubing string to prevent axial movement of the tubular housing in a direction opposite to the retrieval direction;

(h) and wherein the fluid motor includes at least one variable volume pressure cylinder chamber and at least one variable volume reservoir chamber defined between the tubular housing and the mandrel, the hydraulic pump being adapted to deliver hydraulic fluid under pressure to expand the pressure cylinder chamber causing axial movement between the tubular housing and the mandrel, the mandrel being urged in the retrieval direction relative to the tubular housing upon expansion of the pressure cylinder, and the mandrel urging the lower connector means, pulling tool and object in a retrieval direction when the tubular housing is anchored against the interior wall of the tubular string; and (i) wherein the anchoring means comprises a plurality of circumferentially divided slips encircling the mandrel and resiliently urged towards the mandrel, the slips being carried on a slip housing surrounding the mandrel, the slip housing being axially slidable on the mandrel and being provided with means for releasably holding it at a position on the mandrel such that the slips are held at a location to be engaged and actuated by the tubular housing upon axial displacement of the tubular housing by the pressurized fluid, the slip housing being held at least until said slips are anchored against the interior wall of the tubing string.

2. A retrieving tool as claimed in claim 1 wherein the slips at one end define an internal conically curved surface that extends axially toward said tubular housing, the confronting end of said tubular housing being tapered for engagement with the conical surface to urge the slips radially outward into gripping engagement with the interior wall of the tubing string upon axial displacement of the tubular housing by the pressurized fluid.

3. A retrieving tool as claimed in claim 1 wherein the means for releasably holding the slip housing comprise interengaging detent means between the slip housing and the mandrel, the detent means operating to prevent axial movement between the slip housing and the mandrel until a sufficient force is applied to expand the slip housing and release the detent means, the slip housing being formed as a radially expandable collet housing.

4. A wireline retrieval tool for retrieving objects stuck in the interior of a tubing string in a well bore comprising an assembly adapted to be connected to and lowered on a wireline through the interior of a tubing string, the assembly comprising:

(a) upper connecting means for connecting the assembly to the wireline;

(b) lower connecting means for engaging a wireline pulling tool adapted to engage the object;

(c) a fluid motor powered by pressurized fluid supplied by a hydraulic pump driven by an electric motor, the pump and motor being carried in a power subassembly attached to the upper connecting means;

(d) an electrical subsystem for supplying electricity to the electric motor from a power source;

(e) an axially extending mandrel attached at one end to the power subassembly and attached at the other end to the lower connector means;

(f) a tubular housing surrounding the mandrel and axially slidable thereon;

(g) anchoring means adapted to selectively anchor the tubular housing to the interior wall of the tubing string to prevent axial movement of the tubular housing in a direction opposition to the retrieval direction;

(h) and wherein the fluid motor includes at least one variable volume pressure cylinder chamber and at least one variable volume reservoir chamber defined between the tubular housing and the mandrel, the hydraulic pump being adapted to deliver hydraulic fluid under pressure to expand the pressure cylinder chamber causing axial movement between the tubular housing and the mandrel, the mandrel being urged in the retrieval direction relative to the tubular housing upon expansion of the pressure cylinder chamber, and the mandrel urging the lower connector means, pulling tool and object in a retrieval direction when the tubular housing is anchored against the interior wall of the tubing string; and (i) wherein electricity is supplied to the electric motor by a downhole power pack enclosed in a power generator assembly one end of which is attached to a mechanical jar which is in turn connected to the wireline, and the other end of which is attached to the retrieving tool; and wherein, upon upward tension of the wireline sufficient to cause an upward jarring stroke of the mechanical jar, an electrical current through the power generator assembly is closed and electricity is supplied to the electric motor to activate the retrieving tool.

* * * * *